US011294312B2

(12) United States Patent
Noda et al.

(10) Patent No.: US 11,294,312 B2
(45) Date of Patent: Apr. 5, 2022

(54) IMAGE FORMING APPARATUS TO ACCURATELY DETERMINE TEMPERATURE OF HEATING MEMBER

(71) Applicant: BROTHER KOGYO KABUSHIKI KAISHA, Nagoya (JP)

(72) Inventors: Daisuke Noda, Ichinomiya (JP); Yuya Harada, Anjo (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/188,277

(22) Filed: Mar. 1, 2021

(65) Prior Publication Data

US 2021/0278789 A1 Sep. 9, 2021

(30) Foreign Application Priority Data

Mar. 3, 2020 (JP) ..... JP2020-035428
Feb. 19, 2021 (JP) ..... JP2021-025204

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ..... G03G 15/2039
See application file for complete search history.

(56) References Cited

U.S. PATENT DOCUMENTS 9,285,729 B2 * 3/2016 Saito ..... G03G 15/2039
2007/0122170 A1 * 5/2007 Mashiba ..... G03G 15/2039 399/33
2007/0122173 A1 5/2007 Mitsuoka et al.
(Continued)

FOREIGN PATENT DOCUMENTS

JP 2000-259038 A 9/2000
JP 2001-215843 A 8/2001
(Continued)

*Primary Examiner* — Carla J Therrien
(74) *Attorney, Agent, or Firm* — Merchant & Gould P.C.

(57) ABSTRACT

An image forming apparatus includes a heating member, a temperature sensor to output detection values for determining a temperature of the heating member, a first amplifier to amplify a difference value between the detection values with a first amplification factor, a second amplifier to amplify the difference value with a second amplification factor, a converter to generate first temperature information through analog-to-digital conversion of the difference value amplified by the first amplifier, generate second temperature information through analog-to-digital conversion of the difference value amplified by the second amplifier, and generate compensation temperature information, and a temperature determiner to determine the temperature of the heating member based on the second temperature information and the compensation temperature information, in a particular temperature range, and determine the temperature of the heating member based on the first temperature information and the compensation temperature information, outside the particular temperature range.

14 Claims, 7 Drawing Sheets

(56) References Cited

U.S. PATENT DOCUMENTS

| | | | | |
|---|---|---|---|---|
| 2007/0140719 | A1* | 6/2007 | Sato | G03G 15/2039 399/69 |
| 2008/0050139 | A1* | 2/2008 | Nakajima | G03G 15/2039 399/69 |
| 2018/0266894 | A1 | 9/2018 | Nishiyama et al. | |
| 2019/0033142 | A1* | 1/2019 | Nishiyama | G01J 5/24 |

FOREIGN PATENT DOCUMENTS

| | | | |
|---|---|---|---|
| JP | 2002-311752 | A | 10/2002 |
| JP | 2003-257591 | A | 9/2003 |
| JP | 2003-302288 | A | 10/2003 |
| JP | 2007-173218 | A | 7/2007 |
| JP | 2017-106740 | A | 6/2017 |

* cited by examiner

IMAGE FORMING APPARATUS TO ACCURATELY DETERMINE TEMPERATURE OF HEATING MEMBER

CROSS-REFERENCE TO RELATED APPLICATION

This application claims priority under 35 U.S.C. § 119 from Japanese Patent Applications No. 2020-035428 filed on Mar. 3, 2020 and No. 2021-025204 filed on Feb. 19, 2021. The entire subject matter of the applications is incorporated herein by reference.

BACKGROUND

Technical Field

Aspects of the present disclosure are related to an image forming apparatus to determine a temperature of a heating member.

Related Art

An image forming apparatus has been known that is configured to determine a temperature of a heating member using a temperature sensor having a detection thermistor and a compensation thermistor. Specifically, a difference between detection values from the individual thermistors is amplified by an amplifier circuit, then analog-to-digital converted by a conversion circuit, and output to a microcomputer. The microcomputer determines the temperature of the heating member using the converted difference and the output value from the compensation thermistor.

SUMMARY

In general, it is known that a quantization error occurs when a conversion circuit converts an analog value into a digital value. Therefore, there is a concern that an error of the detected temperature relative to an actual temperature of the heating member might be increased due to the quantization error in the conversion circuit.

Aspects of the present disclosure are advantageous to provide one or more improved techniques for an image forming apparatus that make it possible to accurately determine a temperature of a heating member by reducing influences of a quantization error caused when a conversion circuit converts the temperature detected by a temperature sensor.

According to aspects of the present disclosure, an image forming apparatus is provided, which includes a heating member configured to heat a sheet on which a toner image is formed, a temperature sensor including a film configured to absorb infrared rays from the heating member, a detection thermistor configured to output a first detection value corresponding to a temperature of the film, and a compensation thermistor configured to output a second detection value corresponding to a temperature of a holder holding the film, a first amplifier configured to amplify a difference value between the first detection value and the second detection value with a first amplification factor, a second amplifier configured to amplify the difference value between the first detection value and the second detection value with a second amplification factor higher than the first amplification factor, a converter configured to generate first temperature information by performing analog-to-digital conversion of the difference value amplified with the first amplification factor, generate second temperature information by performing analog-to-digital conversion of the difference value amplified with the second amplification factor, and generate compensation temperature information by performing analog-to-digital conversion of the second detection value, and a temperature determiner configured to determine a temperature of the heating member based on the second temperature information and the compensation temperature information, in a particular temperature range, and determine the temperature of the heating member based on the first temperature information and the compensation temperature information, outside the particular temperature range.

According to aspects of the present disclosure, further provided is an image forming apparatus that includes a heating member configured to heat a sheet on which a toner image is formed, a temperature sensor including a detection thermistor configured to output a first detection value corresponding to a surface temperature of the heating member, and a compensation thermistor configured to output a second detection value corresponding to an environmental temperature of the temperature sensor, a first differential amplifier having a first gain and configured to receive an input value corresponding to the first detection value and an input value corresponding to the second detection value, and a second differential amplifier having a second gain and configured to receive an input value corresponding to the first detection value and an input value corresponding to the second detection value, the second gain being larger than the first gain, a converter configured to generate first temperature information by performing analog-to-digital conversion of an output value from the first differential amplifier, generate second temperature information by performing analog-to-digital conversion of an output value from the second differential amplifier, and generate compensation temperature information by performing analog-to-digital conversion of the second detection value, and a temperature determiner configured to determine a temperature of the heating member based on the second temperature information and the compensation temperature information, in a particular temperature range, and determine the temperature of the heating member based on the first temperature information and the compensation temperature information, outside the particular temperature range.

BRIEF DESCRIPTION OF THE ACCOMPANYING DRAWINGS

Figure 9:
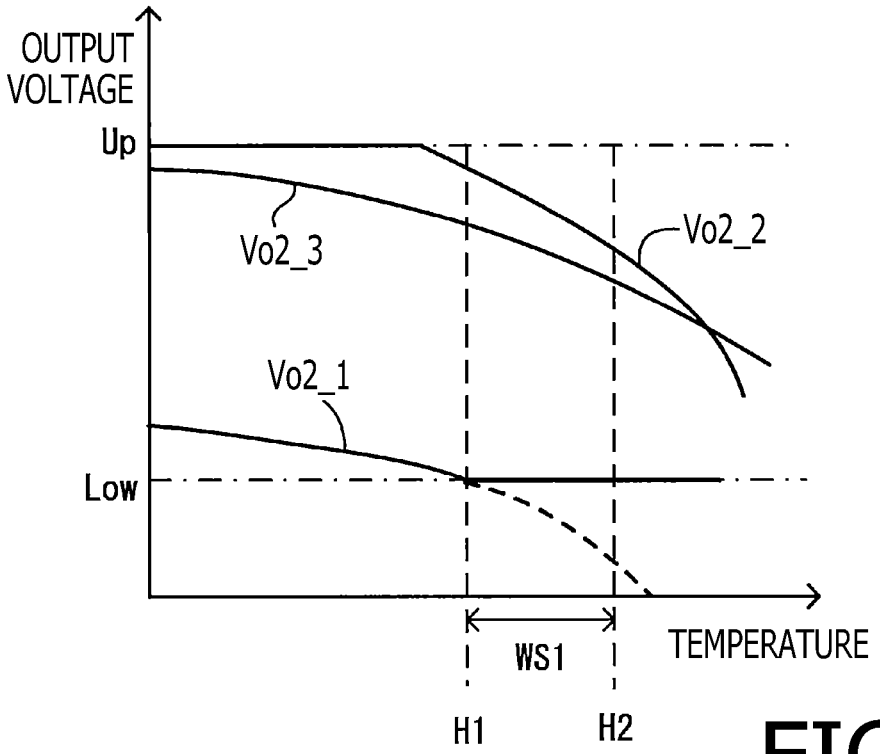

FIG. 9 is a graph, for explaining a conditional temperature range, which shows that individual output voltages, each obtained by amplifying the difference voltage with the second amplification factor, vary depending on the temperature of the heating roller, with respect to respective different temperatures indicated by compensation temperature information, in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an image forming apparatus of an illustrative embodiment according to aspects of the present disclosure will be described with reference to the accompanying drawings. In the illustrative embodiment, the image forming apparatus is a laser printer to form an image on a sheet (e.g., recording paper or a transparency) using toner as a developer.

Figure 1:
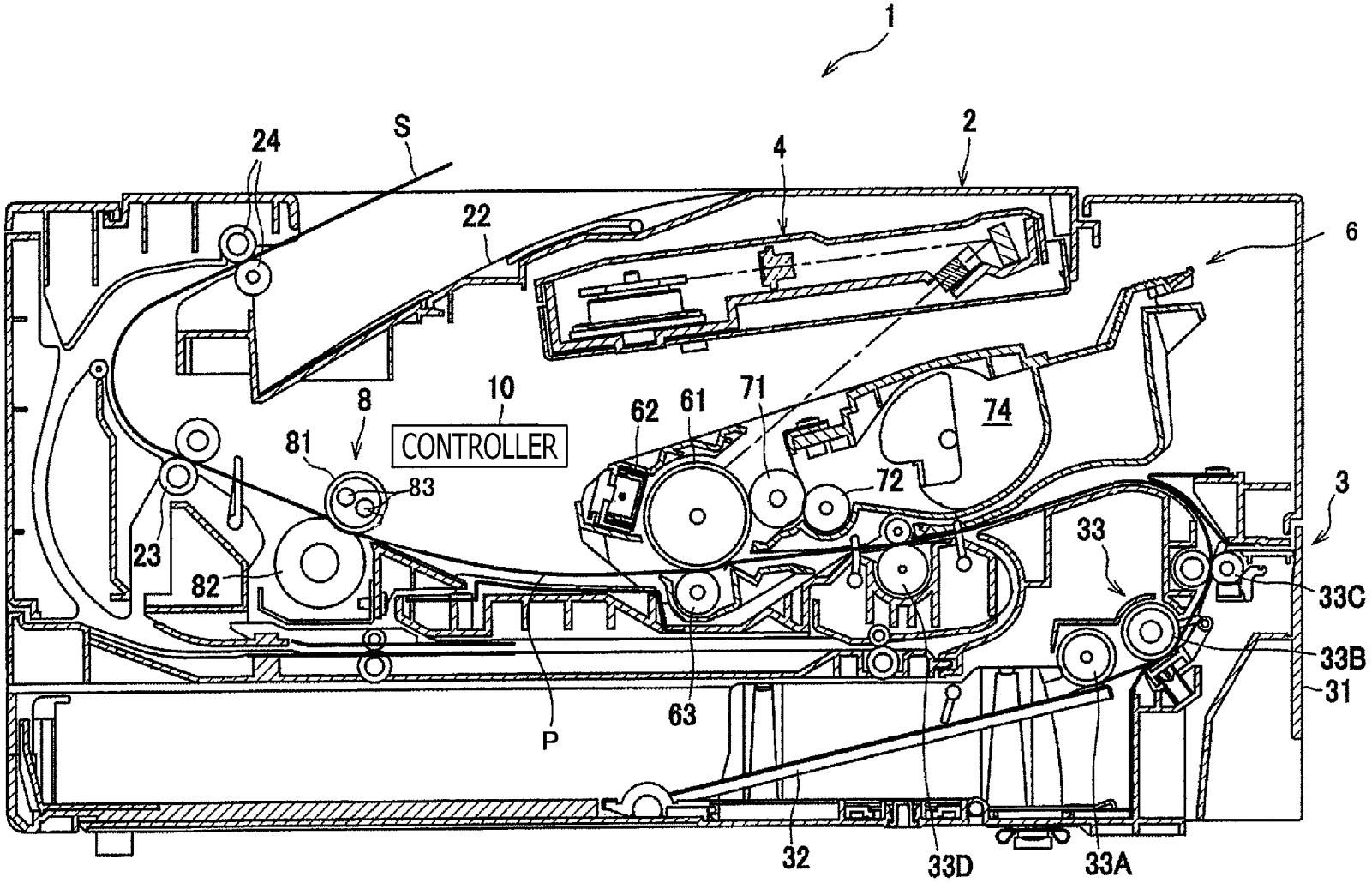
FIG. 1 is a longitudinal sectional view schematically showing a configuration of a laser printer in an illustrative embodiment according to one or more aspects of the present disclosure.

As shown in FIG. 1, a laser printer 1 includes a sheet feeder 3, an exposure device 4, a process unit 6, a fuser 8, a controller 10, and a housing 2 for accommodating the above elements 3, 4, 6, 8, and 10.

The sheet feeder 3 includes a feed tray 31 for accommodating sheets S, a sheet pressing plate 32, and a feeding mechanism 33. The feeding mechanism 33 includes a pickup roller 33A, a separation roller 33B, a first conveyance roller 33C, and a registration roller 33D. In the sheet feeder 3, sheets S in the feed tray 31 are brought to the pickup roller 33A by the sheet pressing plate 32 and fed to the separation roller 33B by the pickup roller 33A. The sheets S are individually separated by the separation roller 33B and are conveyed in a sheet-by-sheet basis by the first conveyance roller 33C. The registration roller 33D, after correcting the skew of a leading end of each individual sheet S, conveys each sheet S toward the process unit 6.

The exposure device 4 includes a laser light source (not shown), a polygon mirror, a lens, and a reflector (which are shown with reference numerals omitted). In the exposure device 4, laser light, emitted from the laser light source based on image data, is scanned on a surface of a below-mentioned photoconductive drum 61 of the process unit 6. Thereby, an electrostatic latent image is formed on the surface of the photoconductive drum 61.

The process unit 6 forms a toner image on a sheet S. The process unit 6 is disposed below the exposure device 4 in the housing 2. The process unit 6 includes the photoconductive drum 61, a charger 62, a transfer roller 63, a development roller 71, a supply roller 72, and a toner container 74 for storing dry toner.

In the process unit 6, the surface of the photoconductive drum 61 is uniformly charged by the charger 62, and thereafter, the electrostatic latent image based on the image data is formed on the surface of the photoconductive drum 61 by the laser light from the exposure device 4. The toner in the toner container 74 is supplied to the development roller 71 via the supply roller 72. The development roller 71 supplies the toner to the photoconductive drum 61 on which the electrostatic latent image is formed. Thereby, the electrostatic latent image is rendered visible, and the toner image is formed on the photoconductive drum 61. Thereafter, when the sheet S fed by the sheet feeder 3 is conveyed between the photoconductive drum 61 and the transfer roller 63, the toner image formed on the photoconductive drum 61 is transferred onto the sheet S.

The sheet S with the toner image transferred thereon is conveyed by the photoconductive drum 61 and the transfer roller 63 to the fuser 8. The fuser 8 fixes the toner image onto the sheet S conveyed from the process unit 6. The fuser 8 includes a heating roller 81 for heating the sheet S, and a pressure roller 82 for pinching the sheet S with the heating roller 81. The heating roller 81 is a cylindrical roller rotatably held in the housing 2. The pressure roller 82 is a roller rotatably held inside the housing 2. In the fuser 8, when the sheet S with the toner image transferred thereon is conveyed between the heating roller 81 and the pressure roller 82, the toner image is thermally fixed onto the sheet S.

Heaters 83 are disposed inside the heating roller 81. In the illustrative embodiment, the heaters 83 are two halogen lamps. Each heater 83 is formed in a shape extending with substantially the same length as a length of the heating roller 81 in a width direction of the heating roller 81. The heaters 83 are arranged side by side inside the heating roller 81.

The sheet S with the toner image thermally fixed thereon is discharged onto a discharge tray 22 by a second conveyance roller 23 and a discharge roller 24.

Figure 2:
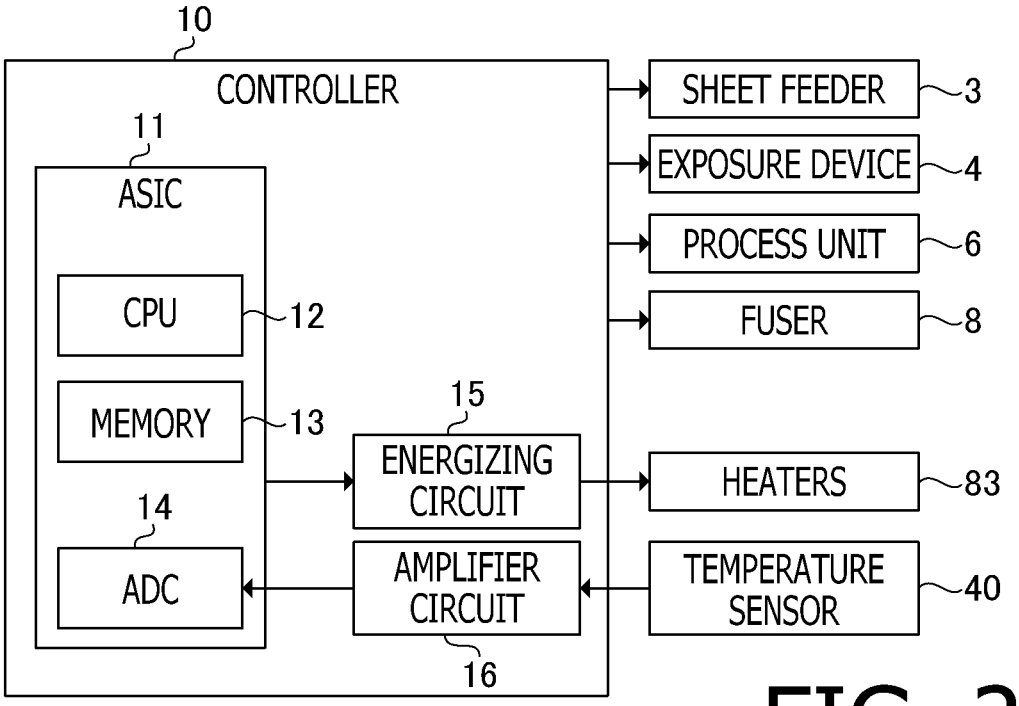
FIG. 2 is a block diagram showing an electrical configuration of the laser printer in the illustrative embodiment according to one or more aspects of the present disclosure.

As shown in FIG. 2, the controller 10 is connected with the sheet feeder 3, the exposure device 4, the process unit 6, and the fuser 8, and controls operations of the aforementioned elements 3, 4, 6, 8, and 83. Specifically, the controller 10 controls a motor for rotating each roller included in the sheet feeder 3, a motor for rotating the heating roller 81 and the pressure roller 82 included in the fuser 8, and further controls emission of light from the light source of the exposure device 4.

The controller 10 is connected with a temperature sensor 40 configured to detect a temperature of the heating roller 81. Detection voltages (i.e., below-mentioned first and second detection voltages Va and Vb) output from the temperature sensor 40 is repeatedly input into the controller 10 at a particular cycle.

The controller 10 controls the temperature of the heating roller 81 using the detection voltages output from the temperature sensor 40. Specifically, the controller 10 controls the temperature of the heating roller 81 within a particular temperature range when fixing the toner onto the sheet in a printing process. On the other hand, the controller 10 controls the temperature of the heating roller 81 within a temperature range lower than the particular temperature range applied in the toner fixing, in a standby mode in which the laser printer 1 does not perform the printing process.

Figure 3:
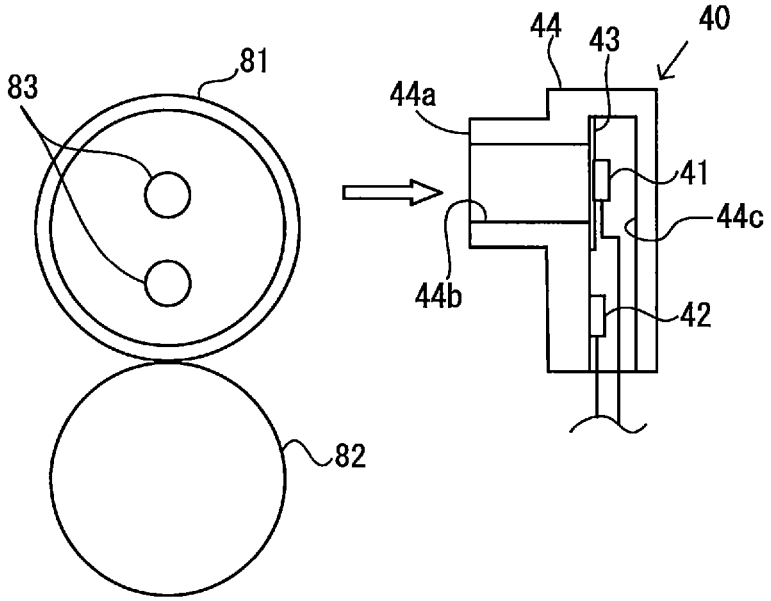
FIG. 3 is an illustration for explaining a configuration of a temperature sensor in the illustrative embodiment according to one or more aspects of the present disclosure.

Next, the temperature sensor 40 will be described. The temperature sensor 40 is a non-contact type sensor. More specifically, in the illustrative embodiment, the temperature sensor 40 is a thermistor temperature sensor. As shown in FIG. 3, the temperature sensor 40 includes a main body 44, a film 43, a detection thermistor 41, and a compensation thermistor 42. The main body 44 has an opening 44*b* that opens in a surface 44*a* facing the heating roller 81. The opening 44*b* extends to a sensor housing space 44*c* for accommodating the detection thermistor 41 and the compensation thermistor 42 inside the main body 44. An end, opposite to the surface 44*a*, of the opening 44*b* is closed by a film 43. The opening 44*b* and the sensor housing space 44*c* are partitioned from each other with the film 43 provided at a boundary therebetween. The detection thermistor 41 is held to be fixed to the film 43, in the sensor housing space 44*c*. The compensation thermistor 42 is held to be fixed to a wall that forms the sensor housing space 44*c*, in the sensor housing space 44*c*.

In the temperature sensor 40 configured as above, infrared rays radiated from the heating roller 81 are transmitted to the film 43 through the opening 44*b* and are absorbed by the film 43. The detection thermistor 41 outputs a first detection voltage Va corresponding to a temperature of the film 43. In other words, the detection thermistor 41 is configured to detect infrared radiation from the heating roller 81 and output the first detection voltage Va corresponding to a surface temperature of the heating roller 81. The compensation thermistor 42 outputs a second detection voltage Vb corresponding to a temperature of the main body 44. In other words, the compensation thermistor 42 is configured to output the second detection voltage Vb corresponding to an environmental temperature of the temperature sensor 40. The first detection voltage Va is an analog signal of which a voltage value varies depending on the temperature of the film 43. The second detection voltage Vb is an analog signal of which a voltage value varies depending on the temperature of the main body 44. The second detection voltage Vb is used to compensate for the first detection voltage Va.

Subsequently, a configuration of the controller 10 will be described. The controller 10 includes an ASIC 11, an energizing circuit 15, and an amplifier circuit 16.

The energizing circuit 15 has a triac as a switching element. The energizing circuit 15 is configured to switch a state of the heaters 83 between an energized state and a de-energized state. The energized state is a state in which the heaters 83 are supplied with an AC voltage from an AC power supply (not shown). The de-energized state is a state in which the heaters 83 are not supplied with the AC voltage.

The amplifier circuit 16 is configured to amplify a difference value between the first detection voltage Va and the second detection voltage Vb received from the temperature sensor 40. The amplifier circuit 16 is further configured to amplify the second detection voltage Vb. A detailed configuration of the amplifier circuit 16 will be described later.

The ASIC 11 includes a CPU 12, a memory 13, and an ADC ("ADC" is an abbreviation of "Analog-to-Digital Converter") 14. The ADC 14 is configured to perform analog-to-digital conversion of the difference value amplified by the amplifier circuit 16, thereby generating temperature information Td. The ADC 14 is further configured to perform analog-to-digital conversion of the second detection voltage Vb amplified by the amplifier circuit 16, thereby generating compensation temperature information Tr. The temperature information Td and the compensation temperature information Tr are digital signals that take discrete values.

The CPU 12 is configured to determine the temperature of the heating roller 81 using the temperature information Td and the compensation temperature information Tr generated by the ADC 14. The memory 13 stores a temperature table that defines the correspondence between the temperature of the heating roller 81 and a combination of the temperature information Td and the compensation temperature information Tr. By referring to the temperature table, the CPU 12 determines, as the temperature of the heating roller 81, a temperature associated with the combination of the temperature information Td and the compensation temperature information Tr. In another instance, the CPU 12 may calculate a temperature by an arithmetic operation using the temperature information Td and the compensation temperature information Tr, and may determine the calculated temperature as the temperature of the heating roller 81.

Using the determined temperature of the heating roller 81, the CPU 12 variably controls an energizing time to supply the AC voltage to the heaters 83 by the energizing circuit 15. Specifically, the ASIC 11 generates a heater drive signal based on the temperature of the heating roller 81 and outputs the generated heater drive signal to the energizing circuit 15. The heater drive signal is a signal to determine an amount of AC power supplied to the heaters 83 by the energizing circuit 15. More specifically, the heater drive signal is a signal for on-off operating the triac.

Figure 4:
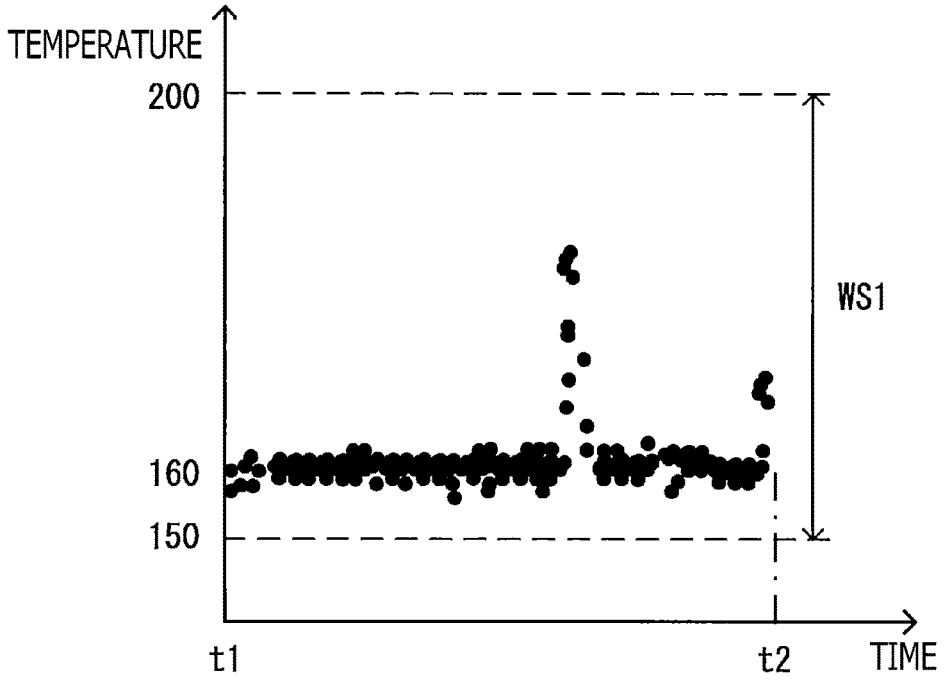
FIG. 4 is a graph, for explaining a particular temperature range, which shows changes in a temperature of a heating roller when a toner image formed on a sheet is thermally fixed by the fuser, in the illustrative embodiment according to one or more aspects of the present disclosure.

Next, changes in the temperature of the heating roller 81 will be described. FIG. 4 shows changes in the temperature of the heating roller 81 when the fuser 8 is fixing a toner image onto a sheet S. More specifically, FIG. 4 shows changes in the temperature of the heating roller 81 during a period of time (t1 to t2) when the sheet S passes between the heating roller 81 and the pressure roller 82.

Before the time t1, the temperature of the heating roller 81 rises as the heaters 83 begin to be supplied with the AC power. At and after the time t1, the sheet S is pinched between the heating roller 81 and the pressure roller 82, and the temperature of the heating roller 81 varies around 160[° C.]. Although the following features are not shown in FIG. 4, at and after the time t2, the sheet S is not pinched between the heating roller 81 and the pressure roller 82, and the temperature of the heating roller 81 temporarily increases. Therefore, while the toner image is being fixed onto the sheet S, the temperature of the heating roller 81 varies within the particular temperature range WS1 from 150[° C.] to 200[° C.]. Namely, the particular temperature range WS1 is considered as a temperature range within which the temperature of the heating roller 81 is likely to be while the toner image is being fixed onto the sheet S.

If a quantization error in the analog-to-digital conversion by the ADC 14 for the temperature of the heating roller 81 becomes large in the particular temperature range WS1, the toner image may not be properly fixed. The inventors focused on a fact that the temperature of the heating roller 81 changes within the particular temperature range WS1 during the period of time when the toner image is being fixed on the sheet S. Then, the inventors came up with an idea of using the temperature information Td having a high resolution only in the particular temperature range WS1 when the temperature of the heating roller 81 is included in the particular temperature range WS1. Specifically, when the temperature of the heating roller 81 is not included in the particular temperature range WS1, the temperature control for the heating roller 81 is performed using first temperature information TdA. The first temperature information TdA is temperature information Td having a certain range of resolution in the entire temperature range which the temperature of the heating roller 81 is considered likely to be within. On the other hand, when the temperature of the heating roller 81 is included in the particular temperature range WS1, the temperature control for the heating roller 81 is performed using second temperature information TdB. The second temperature information TdB has a higher resolution in the particular temperature range WS1 than the first temperature information TdA.

Figure 5:
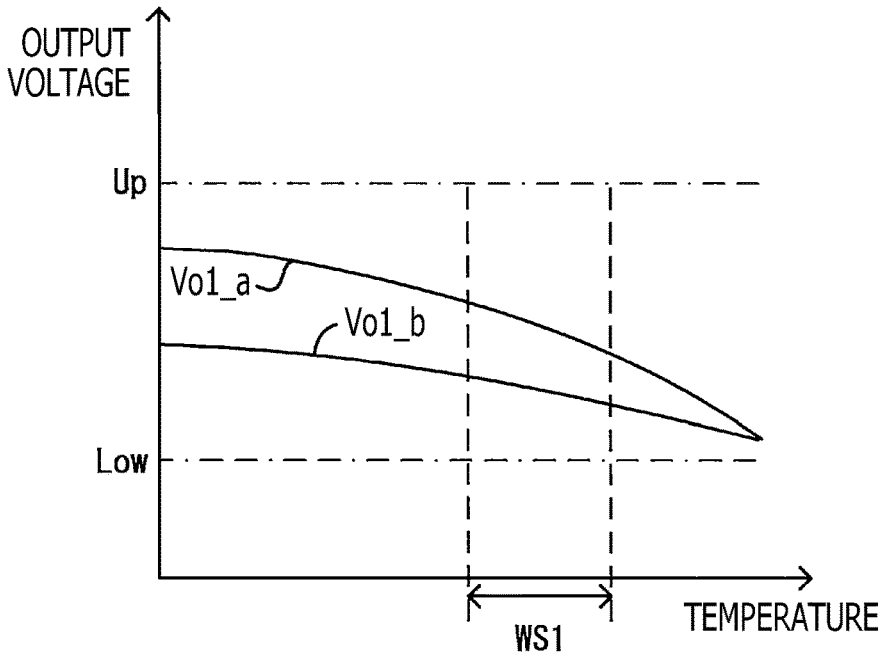
FIG. 5 shows temperature dependencies of output voltages each obtained by amplifying a difference voltage with a first amplification factor, in the illustrative embodiment according to one or more aspects of the present disclosure.
Figure 6:
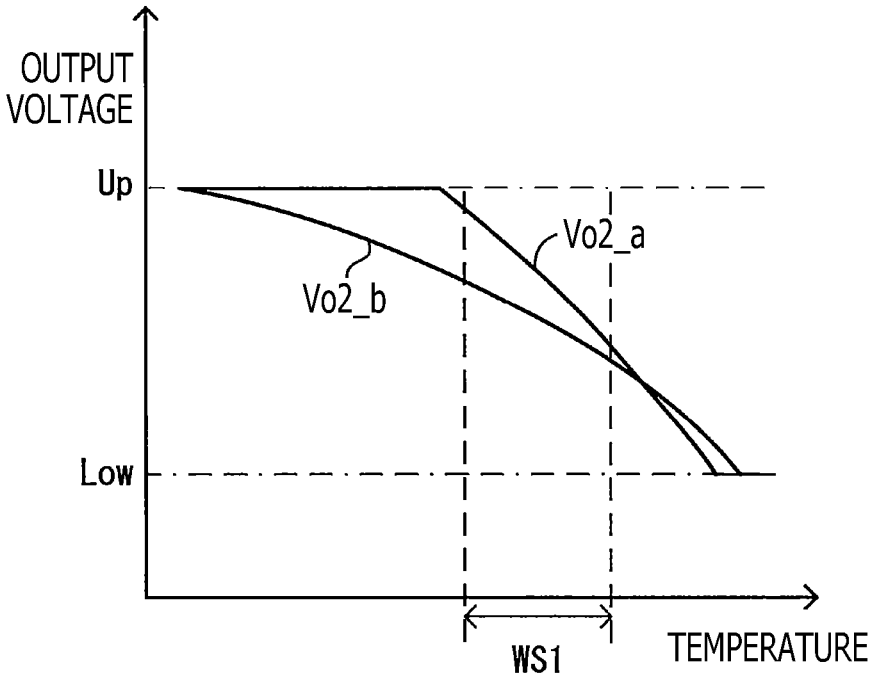
FIG. 6 shows temperature dependencies of output voltages each obtained by amplifying the difference voltage with a second amplification factor, in the illustrative embodiment according to one or more aspects of the present disclosure.

Next, a principle for changing the resolution of the temperature information Td will be described. FIG. 5 shows temperature dependencies of output voltages Vo1 each obtained by amplifying a difference voltage ΔV with a first amplification factor A1. The difference voltage ΔV is a voltage corresponding to a difference between the first detection voltage Va and the second detection voltage Vb. A horizontal axis indicates the temperature of the heating roller 81. In FIG. 5, "Vo1_*a*" and "Vo1_*b*" represent respective values of the output voltages Vo1 corresponding to different second detection voltages Vb. FIG. 6 shows temperature dependencies of output voltages Vo2 each obtained by amplifying the difference voltage ΔV with a second amplification factor A2. A horizontal axis indicates the temperature of the heating roller 81. The second amplification factor A2 is higher than the first amplification factor A1. Each amplification factor may not necessarily be a linear value but may be defined by a non-linear function. Further, a lower limit and an upper limit of a range of acceptable input voltages to the ADC 14 are shown as "Low" and "Up," respectively.

The output voltages Vo1_*a* and Vo1_*b* (see FIG. 5) amplified with the first amplification factor A1 decrease slowly as the temperature of the heating roller 81 increases. Namely, slopes, indicating the individual changes in the output voltages Vo1_*a* and Vo1_*b* with respect to the change in the temperature of the heating roller 81, are small. On the other hand, the output voltages Vo2_*a* and Vo2_*b* (see FIG. 6) amplified with the second amplification factor A2 have larger slopes of their respective voltage values changing depending on the temperature of the heating roller 81 than the slopes of the output voltages Vo1_*a* and Vo1_*b* (see FIG. 5) amplified with the first amplification factor A1. Therefore, in the particular temperature range WS1, the second temperature information TdB calculated using the output voltages Vo2_*a* and Vo2_*b* amplified with the second amplification factor A2 has a higher resolution than the first temperature information TdA calculated using the output voltages Vo1_*a* and Vo1_*b* amplified with the first amplification factor A1.

On the other hand, with respect to the output voltage Vo2 amplified with the second amplification factor A2, outside the particular temperature range WS1, there are temperatures at which voltage values of the said output voltage Vo2 are higher than the upper limit "Up," and temperatures at which that voltage values of the said output voltage Vo2 are lower than the lower limit "Low." The output voltage Vo2 amplified with the second amplification factor A2 is saturated to be the upper limit "Up" at such temperatures that voltage values of the said output voltage Vo2 are higher than the upper limit "Up." Further, the output voltage Vo2 amplified with the second amplification factor A2 is saturated to be the lower limit "Low" at such temperatures that voltage values of the said output voltage Vo2 are lower than the lower limit "Low." Therefore, outside the particular temperature range WS1, the first temperature information TdA is more accurate than the second temperature information TdB.

Figure 7:
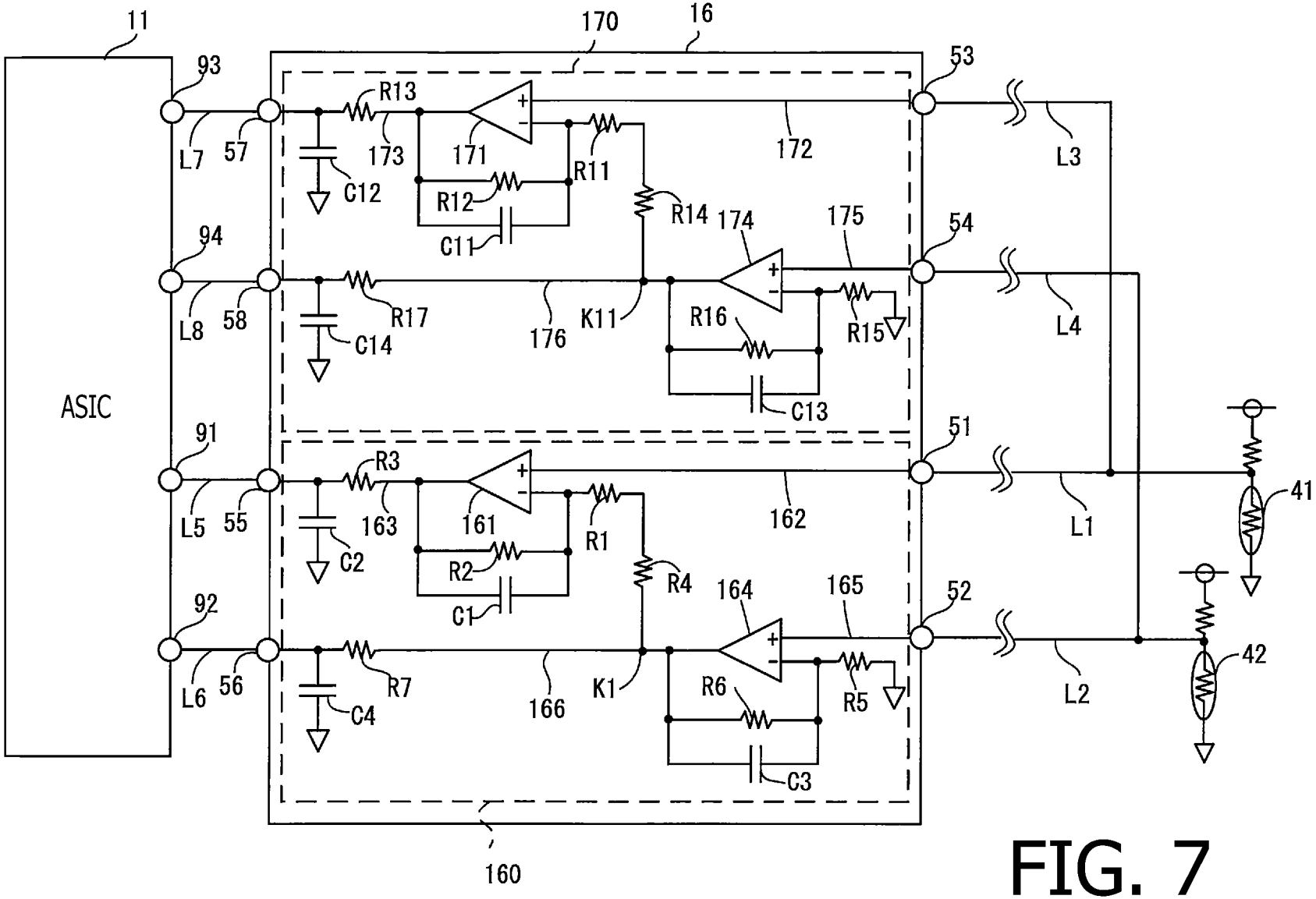
FIG. 7 is a schematic diagram showing a configuration of an amplifier circuit connected with an ASIC, in the illustrative embodiment according to one or more aspects of the present disclosure.

Next, a specific configuration of the amplifier circuit 16 will be described with reference to FIG. 7. The amplifier circuit 16 has a first input terminal 51, a second input terminal 52, a third input terminal 53, and a fourth input terminal 54 that are connected with the temperature sensor 40. Specifically, the first input terminal 51 is connected with the detection thermistor 41 via a first connection line L1. Thereby, the first detection voltage Va is input into the first input terminal 51. The second input terminal 52 is connected with the compensation thermistor 42 via a second connection line L2. Thereby, the second detection voltage Vb is input into the second input terminal 52. The third input terminal 53 is connected with the detection thermistor 41 via a third connection line L3 that branches off from the first connection line L1. Thereby, the first detection voltage Va is input into the third input terminal 53. The fourth input terminal 54 is connected with the compensation thermistor 42 via a fourth connection line L4 that branches off from the second connection line L2. Thereby, the second detection voltage Vb is input into the fourth input terminal 54.

In addition, the amplifier circuit 16 has a first output terminal 55 and a third output terminal 57 that output the output voltages Vo. Further, the amplifier circuit 16 has a second output terminal 56 and a fourth output terminal 58 that output sub-output voltages Vs. Specifically, the first output terminal 55 is connected with a first difference voltage terminal 91 of the ASIC 11 via a connection line L5. The second output terminal 56 is connected with a first compensation voltage terminal 92 of the ASIC 11 via a connection line L6. The third output terminal 57 is connected with a second difference voltage terminal 93 of the ASIC 11 via a connection line L7. The fourth output terminal 58 is connected with a second compensation voltage terminal 94 of the ASIC 11 via a connection line L8.

The amplifier circuit 16 includes a first amplifier 160 and a second amplifier 170. The first amplifier 160 is configured to amplify the difference voltage ΔV corresponding to the difference between the first detection voltage Va and the second detection voltage Vb, with the first amplification factor A1. The second amplifier 170 is configured to amplify the difference voltage ΔV corresponding to the difference between the first detection voltage Va and the second detection voltage Vb, with the second amplification factor A2. It is noted that the second amplification factor A2 is larger than the first amplification factor A1. As described above, the difference voltage ΔV amplified by the first amplifier 160 with the first amplification factor A1 may be referred to as the output voltage Vo1. Further, the difference voltage ΔV amplified by the second amplifier 170 with the second amplification factor A2 may be referred to as the output voltage Vo2.

The first amplifier 160 includes a first main operational amplifier 161 and a first sub operational amplifier 164 that function as non-inverting amplifiers. A non-inverting input terminal of the first main operational amplifier 161 is connected with a first input line 162 leading to the first input terminal 51. Thereby, the first detection voltage Va from the detection thermistor 41 is input into the non-inverting input terminal of the first main operational amplifier 161. An output terminal of the first main operational amplifier 161 is connected with one end of the first output line 163 with which a resistor R3 is connected in series. The other end of the first output line 163 is connected with a first output terminal 55. An inverting input terminal and the output terminal, of the first main operational amplifier 161, are connected with each other via a resistor R2. In the illustrative embodiment, a capacitor C1 is connected in parallel with the resistor R2. The first output line 163 is connected with the signal ground via a capacitor C2.

A non-inverting input terminal of the first sub operational amplifier 164 is connected with a second input line 165 leading to the second input terminal 52. Thereby, the second detection voltage Vb from the compensation thermistor 42 is input into the non-inverting input terminal of the first sub operational amplifier 164. An inverting input terminal of the first sub operational amplifier 164 is connected with the signal ground via a resistor R5. An output terminal of the first sub operational amplifier 164 is connected with one end of a second output line 166 with which a resistor R7 is connected in series. The other end of the second output line 166 is connected with the second output terminal 56. The inverting input terminal and the output terminal, of the first sub operational amplifier 164, are connected with each other via a resistor R6. In the illustrative embodiment, a capacitor C3 is connected in parallel with the resistor R6. The second output line 166 is connected with the signal ground via a capacitor C4.

The inverting input terminal of the first main operational amplifier 161 and the output terminal of the first sub operational amplifier 164 are connected with each other via a resistor R4. Specifically, one end of the resistor R4 is connected with a resistor R1 leading to the inverting input terminal of the first main operational amplifier 161. Further, the other end of the resistor R4 is connected with a contact point K1 on the second output line 166. The contact point K1 is between the register R7 and a contact point with which the register R6 is connected on the second output line 166.

In the first amplifier 160 configured as above, the second detection voltage Vb input via the second input terminal 52 is amplified by the first sub operational amplifier 164 and then output to the second output terminal 56. From the output terminal of the first sub operational amplifier 164, a voltage, obtained by amplifying with a third gain G3 (=(R5+R6)/R5) the second detection voltage Vb input into the non-inverting input terminal of the first sub operational amplifier 164, is output as a sub-output voltage Vs1. The sub-output voltage Vs1, output from the first sub operational amplifier 164, is also output to the inverting input terminal of the first main operational amplifier 161 via the resistor R4.

The first main operational amplifier 161 amplifies the difference between the sub-output voltage Vs1 input into the inverting input terminal of the first main operational amplifier 161 and the first detection voltage Va input into the non-inverting input terminal of the first main operational amplifier 161. Then, the first main operational amplifier 161 outputs the output voltage Vo1 to the first output terminal 55. Here, a resistance value of resistor R2 is larger than a resistance value of resistor R1. Thus, from the output terminal of the first main operational amplifier 161, a voltage, obtained by amplifying with a first gain G1 (=(R1+R2)/R1) the difference between the first detection voltage Va input into the non-inverting input terminal of the first main operational amplifier 161 and the sub-output voltage Vs1 output from the first sub operational amplifier 164, is output as the output voltage Vo1. It is noted that the first gain G1 is a major factor for determining the first amplification factor A1.

In the illustrative embodiment, the third gain G3 has only to be set to such a value that the second detection voltage Vb amplified with the third gain G3 is not saturated in a range of temperatures to be detected using the second detection voltage Vb amplified. For instance, the range of temperatures to be detected using the second detection voltage Vb amplified is a temperature range between a temperature (e.g., 0[° C.]) set as a lower limit in operating conditions for the laser printer 1 and a temperature (e.g., 150[° C.]) set as an upper limit of a heat-resistant temperature range for the temperature sensor 40.

The second amplifier 170 includes a second main operational amplifier 171 and a second sub operational amplifier 174 that function as non-inverting amplifiers. A non-inverting input terminal of the second main operational amplifier 171 is connected with a third input line 172 leading to the third input terminal 53. Thereby, the first detection voltage Va from the detection thermistor 41 is input into the non-inverting input terminal of the second main operational amplifier 171. An output terminal of the second main operational amplifier 171 is connected with one end of the third output line 173 with which a resistor R13 is connected in series. The other end of the third output line 173 is connected with the third output terminal 57. An inverting input terminal and an output terminal, of the second main operational amplifier 171, are connected with each other via a resistor R12. In the illustrative embodiment, a capacitor C11 is connected in parallel with the resistor R12. The third output line 173 is connected with the signal ground via a capacitor C12.

A non-inverting input terminal of the second sub operational amplifier 174 is connected with a fourth input line 175 leading to the fourth input terminal 54. Thereby, the second detection voltage Vb from the compensation thermistor 42 is input into the non-inverting input terminal of the second sub operational amplifier 174. An inverting input terminal of the second sub operational amplifier 174 is connected with the signal ground via a resistor R15. An output terminal of the second sub operational amplifier 174 is connected with one end of the fourth output line 176 with which a resistor R17 is connected in series. The other end of the fourth output line 176 is connected with the fourth output terminal 58. The inverting input terminal and the output terminal, of the second sub operational amplifier 174, are connected with each other via a resistor R16. In the illustrative embodiment, a capacitor C13 is connected in parallel with the resistor R16. The fourth output line 176 is connected with the signal ground via a capacitor C14.

The inverting input terminal of the second main operational amplifier 171 and the output terminal of the second sub operational amplifier 174 are connected with each other via a resistor R14. Specifically, one end of the resistor R14 is connected with a resistor R11 leading to the inverting input terminal of the second main operational amplifier 171. The other end of the resistor R14 is connected with a contact K11 on the fourth output line 176. The contact K11 is between the resistor R17 and a contact with which the resistor R16 is connected on the fourth output line 176.

In the second amplifier 170 configured as above, the second detection voltage Vb input via the fourth input terminal 54 is amplified by the second sub operational amplifier 174 and then output from the fourth output terminal 58. From the output terminal of the second sub operational amplifier 174, a voltage, obtained by amplifying with a fourth gain G4 (=(R15+R16)/R15) the voltage input into the non-inverting input terminal of the second sub operational amplifier 174, is output as a sub-output voltage Vs2. The sub-output voltage Vs2, output from the second sub operational amplifier 174, is also output to the inverting input terminal of the second main operational amplifier 171 via the resistor R14.

The second main operational amplifier 171 amplifies the difference between the sub-output voltage Vs2 input into the inverting input terminal of the second main operational amplifier 171 and the first detection voltage Va input into the non-inverting input terminal of the second main operational amplifier 171. Then, the second main operational amplifier 171 outputs the output voltage Vo2 to the third output terminal 57. Here, a resistance value of the resistor R12 is larger than a resistance value of resistor R11. Thereby, from the output terminal of the second main operational amplifier 171, a voltage, obtained by amplifying with a second gain G2 (=(R11+R12)/R11) the difference between the first detection voltage Va input into the non-inverting input terminal of the second main operational amplifier 171 and sub-output voltage Vs2 input into the inverting input terminal of the second main operational amplifier 171, is output as the output voltage Vo2. The resistance values of the individual resistors R1, R2, R11, and R12 are set to such values that the second gain G2 is larger than the first gain G1. In the illustrative embodiment, the fourth gain G4 has only to be set to such a value that the sub-output voltage Vs2 is not saturated in a range of temperatures to be detected using the second detection voltage Vb amplified.

The output voltage Vo1 input via the first difference voltage terminal 91 and the sub-output voltage Vs1 input via the first compensation voltage terminal 92 are input into the ADC 14 of the controller 10. The ADC 14 performs analog-to-digital conversion of the output voltage Vo1 and calculates the first temperature information TdA. Further, the ADC 14 performs analog-to-digital conversion of the sub-output voltage Vs1 amplified and calculates first compensation temperature information TrA. The output voltage Vo2 input via the second difference voltage terminal 93 and the sub-output voltage Vs2 input via the second compensation voltage terminal 94 are input to the ADC 14 of the controller 10. The ADC 14 performs analog-to-digital conversion of the output voltage Vo2 and calculates the second temperature information TdB. Further, the ADC 14 performs analog-to-digital conversion of the sub-output voltage Vs2 and calculates second compensation temperature information TrB.

Figure 8:
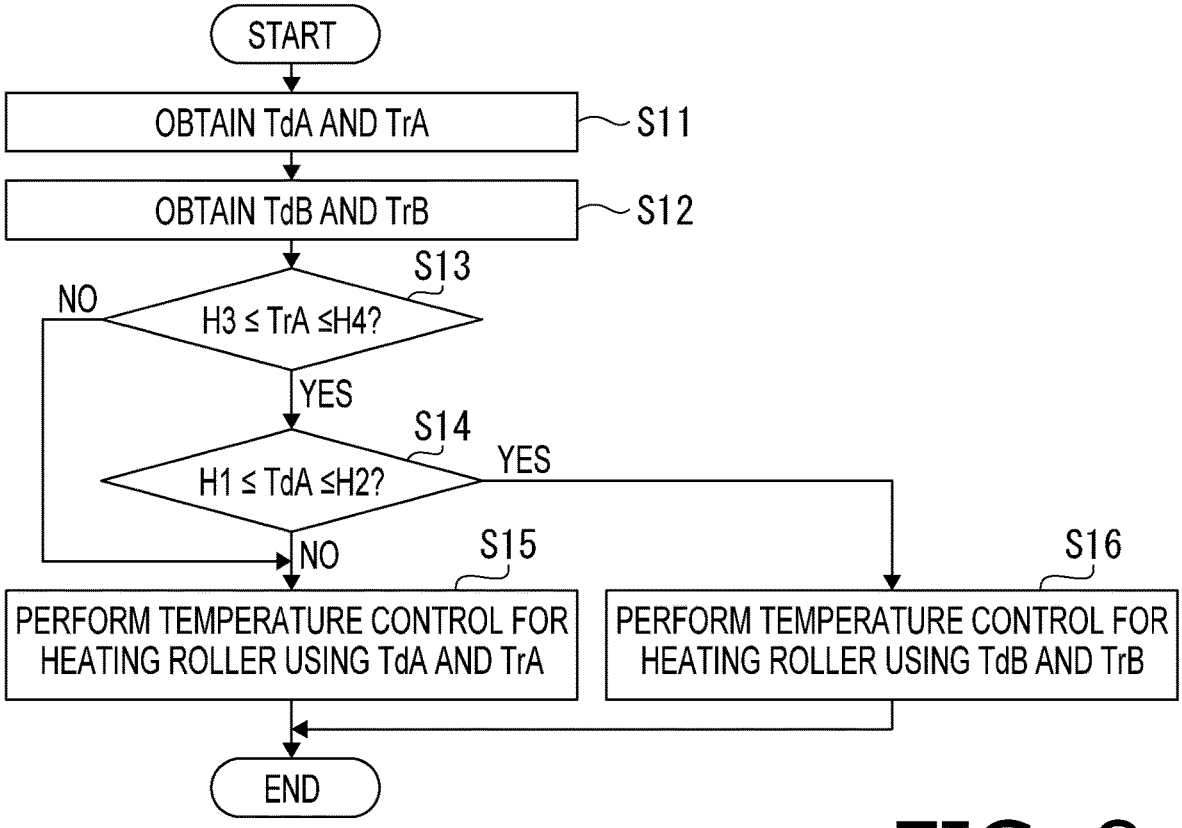
FIG. 8 is a flowchart showing a procedure of temperature control for the heating roller, in the illustrative embodiment according to one or more aspects of the present disclosure.

Subsequently, temperature control using the first temperature information TdA, the second temperature information TdB, the first compensation temperature information TrA, and the second compensation temperature information TrB will be described with reference to FIG. 8. The process shown in FIG. 8 is a process to be executed by the CPU 12 in response to the laser printer 1 beginning to fix the toner image onto the sheet S.

In S11, the CPU 12 obtains the first temperature information TdA and the first compensation temperature information TrA generated by the ADC 14. In S12, the CPU 12 obtains the second temperature information TdB and the second compensation temperature information TrB generated by the ADC 14.

In S13, the CPU 12 determines whether a temperature indicated by the first compensation temperature information TrA is included in a conditional temperature range WS2. The conditional temperature range WS2 is a range of the temperature indicated by the compensation temperature information Tr to accurately detect the second temperature information TdB in the particular temperature range WS1. FIG. 9 shows temperature dependencies of output voltages Vo2 each obtained by amplifying the difference voltage ΔV with the second amplification factor A2. In FIG. 9, an output voltage Vo2_1 is an output voltage when the compensation temperature information Tr indicates "10° C." An output voltage Vo2_2 is an output voltage when the compensation temperature information Tr indicates "80° C." An output voltage Vo2_3 is an output voltage when the compensation temperature information Tr indicates "100° C."

The output voltage Vo2_1 is saturated to be the lower limit "Low" of the range of acceptable input voltages to the ADC 14, in the particular temperature range WS1. It is noted that, hereinafter, the range of acceptable input voltages to the ADC 14 may be simply referred to as the "input voltage range." This is because the output voltage Vo2_1, amplified with the second amplification factor A2, is lower than the lower limit "Low" in the particular temperature range WS1, as indicated by a dashed line in FIG. 9. Namely, the second temperature information TdB calculated using the first detection voltage Va_1 is inaccurate in the particular temperature range WS1. On the other hand, the output voltage Vo2_2 and the output voltage Vo2_3 have their values between the upper limit "Up" and the lower limit "Low" of the input voltage range, in the particular temperature range WS1.

Therefore, in the illustrative embodiment, the range of the temperature indicated by the first compensation temperature information TrA in the particular temperature range WS1 is set to the conditional temperature range WS2 in which the second temperature information TdB is not rendered inaccurate. For instance, the conditional temperature range is a temperature range within which the temperature of the main body 44 of the temperature sensor 40 is assumed to be while the toner image is being fixed onto the sheet S. Specifically, for instance, the conditional temperature range is a temperature range having a lower limit H3 of 20[° C.] and an upper limit H4 of 125[° C.].

When determining in S13 that the temperature indicated by the first compensation temperature information TrA is included in the conditional temperature range WS2 (S13: Yes), the CPU 12 goes to S14. In S14, the CPU 12 determines whether a temperature indicated by the first temperature information TdA is included in the particular temperature range WS1. Specifically, in S13, the CPU 12 determines whether the temperature indicated by the first compensation temperature information TrA is equal to or higher than the lower limit H3 of the conditional temperature range WS2 and is equal to or lower than the upper limit H4 of the conditional temperature range WS2.

When making an affirmative determination in S13, i.e., determining that the temperature indicated by the first compensation temperature information TrA is included in the conditional temperature range WS2 (S13: Yes), the CPU 12 goes to S14. In S14, the CPU 12 determines whether the temperature of the heating roller 81 is included in the particular temperature range WS1. Specifically, in the illustrative embodiment, the CPU 12 determines in S14 whether the temperature indicated by the first temperature information TdA is equal to or higher than the lower limit H1 of the particular temperature range WS1 and is equal to or lower than the upper limit H2 of the particular temperature range WS1.

When making an affirmative determination in S14, i.e., determining that the temperature of the heating roller 81 is included in the particular temperature range WS1 (S14: Yes), the CPU 12 goes to S16. When the temperature of the heating roller 81 is included in the particular temperature range WS1, a resolution of the temperature indicated by the second temperature information TdB is higher than a resolution of the temperature indicated by the first temperature information TdA. Therefore, in S16, the CPU 12 performs temperature control for the heating roller 81 using the second temperature information TdB and the second compensation temperature information TrB. As described above, by referring to the temperature table, the CPU 12 determines the temperature of the heating roller 81 corresponding to the combination of the second temperature information TdB and the second compensation temperature information TrB. Then, the CPU 12 generates a heater drive signal using the determined temperature, and outputs the generated heater drive signal to the energizing circuit 15.

When determining that the temperature indicated by the first compensation temperature information TrA is not included in the conditional temperature range WS2 (S13: No), or determining that the temperature of the heating roller 81 is not included in the particular temperature range WS1 (S14: No), the CPU 12 goes to S15. When the CPU 12 proceeds to S15, the second temperature information TdB is more inaccurate than the first temperature information TdA. Therefore, in the illustrative embodiment, the temperature control for the heating roller 81 is performed using the first temperature information TdA and the first compensation temperature information TrA.

After completion of S15 or S16, the CPU 12 once terminates the process shown in FIG. 8.

The illustrative embodiment described above produces the following effects. The laser printer 1 includes the first amplifier 160 and the second amplifier 170. The first amplifier 160 amplifies with the first amplification factor A1 the difference between the first detection voltage Va and the second detection voltage Vb output from the temperature sensor 40. The second amplifier 170 amplifies with the second amplification factor A2 the difference between the first detection voltage Va and the second detection voltage Vb. The ADC 14 performs analog-to-digital conversion of the difference amplified by the first amplifier 160 and generates the first temperature information TdA. Further, the ADC 14 performs analog-to-digital conversion of the difference amplified by the second amplifier 170 and generates the second temperature information TdB. The CPU 12 determines the temperature of the heating roller 81 in the particular temperature range WS1 based on the second temperature information TdB and the second compensation temperature information TrB. Further, the CPU 12 determines the temperature of the heating roller 81 outside the particular temperature range WS1 based on the first temperature information TdA and the first compensation temperature information TrA.

Thereby, in the particular temperature range WS1, the temperature of the heating roller 81 is determined using the second temperature information TdB that has a high temperature resolution in the particular temperature range WS1. Hence, it is possible to accurately detect the temperature of the heating roller 81 by reducing influences of a quantization error caused when the ADC 14 converts the detected temperature of the heating roller 81.

The first amplifier 160 has the first main operational amplifier 161 and the resistors R1 and R2 for setting the first amplification factor A1 of the first main operational amplifier 161. The second amplifier 170 has the second main operational amplifier 171 and the resistors R11 and R12 for setting the second amplification factor A2 of the second main operational amplifier 171. Thus, by adjusting the resistance differences among the individual resistors R1, R2, R11, and R12, it is possible to determine how large or small the respective amplification factors A1 and A2 of the first amplifier 160 and the second amplifier 170 are relative to each other.

When the temperature indicated by the first temperature information TdA is included in the particular temperature range WS1, the CPU 12 performs temperature control for the heating roller 81 using the temperature determined based on the second temperature information TdB and the second compensation temperature information TrB. Thereby, it is possible to accurately control the temperature of the heating roller 81.

When the temperature indicated by the first compensation temperature information TrA is included in the conditional temperature range WS2, and the temperature indicated by the first temperature information TdA is included in the particular temperature range WS1, the CPU 12 performs temperature control for the heating roller 81 using the temperature determined based on the second temperature information TdB and the second compensation temperature information TrB. Thereby, it is possible to further accurately control the temperature of the heating roller 81.

When the temperature indicated by the first compensation temperature information TrA is not included in the conditional temperature range WS2, or the temperature indicated by the first temperature information Td is not included in the particular temperature range WS1, the CPU 12 performs temperature control for the heating roller 81 using the temperature determined based on the first temperature information TdA and the first compensation temperature information TrA. Thereby, a reduction in accuracy for the temperature control may be suppressed as much as possible.

Hereinabove, the illustrative embodiment according to aspects of the present disclosure has been described. Aspects of the present disclosure may be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein. For instance, the following modifications may be feasible.

(Modifications)

In S14 of the process shown in FIG. 8, the CPU 12 may determine whether the temperature of the heating roller 81 is included in the particular temperature range WS1, using the second temperature information TdB.

In S13 of the process shown in FIG. 8, the CPU 12 may determine whether a temperature indicated by the second compensation temperature information TrB is included in the conditional temperature range WS2.

It is merely one example that the temperature range, within which the temperature of the heating roller 81 is likely to be while the toner image is being fixed onto the sheet S, is used as the particular temperature range WS1. For instance, a temperature range, within which the temperature of the heating roller 81 is likely to be when the laser printer 1 is in the standby mode in which the laser printer 1 does not perform a printing process, may be used as the particular temperature range WS1.

The conditional temperature range WS2 and the particular temperature range WS1 may overlap in some temperatures. For instance, the upper limit H4 of the conditional temperature range WS2 may be higher than the lower limit H1 of the particular temperature range WS1.

Functions of a "temperature determiner" and a "temperature controller" according to aspects of the present disclosure may not necessarily be performed by the ASIC 11. For instance, the laser printer 1 may include a plurality of ASICs and/or a plurality of CPUs. In such a case, the functions of determining and controlling the temperature of the heating roller 81 may be performed by at least one of the ASICs and/or the CPUs.

The image forming apparatus according to aspects of the present disclosure is not limited to the laser printer 1 but may be a copy machine or a multi-function peripheral. The image forming apparatus may also be a color printer having a plurality of process units corresponding to respective different colors.

A heating member according to aspects of the present disclosure is not limited to the heating roller 81. For instance, the heating member may be a heating belt that includes an endless belt and a heater configured to heat an inner circumferential surface of the belt. In another instance, the heating member may be an externally-heated type heating member, which includes a rotatable body including a roller or a belt, and a heater configured to heat an outer circumferential surface of the rotatable body.

The following shows examples of associations between elements exemplified in the aforementioned illustrative embodiment and modifications and elements according to aspects of the present disclosure. The laser printer 1 may be an example of an "image forming apparatus" according to aspects of the present disclosure. The heating roller 81 may be an example of a "heating member" according to aspects of the present disclosure. The temperature sensor 40 may be an example of a "temperature sensor" according to aspects of the present disclosure. The film 43 may be an example of a "film" according to aspects of the present disclosure. The detection thermistor 41 may be an example of a "detection thermistor" according to aspects of the present disclosure. The compensation thermistor 42 may be an example of a "compensation thermistor" according to aspects of the present disclosure. The main body 44 of the temperature sensor 40 may be an example of a "holder" according to aspects of the present disclosure. The first amplifier 160 may be an example of a "first amplifier" according to aspects of the present disclosure. The second amplifier 170 may be an example of a "second amplifier" according to aspects of the present disclosure. The ADC 14 may be an example of a "converter" according to aspects of the present disclosure. The CPU 12 may be an example of a "temperature determiner" according to aspects of the present disclosure. The CPU 12 may be an example of a "temperature controller" according to aspects of the present disclosure. The first detection voltage Va may be an example of a "first detection value" according to aspects of the present disclosure. The second detection voltage Vb may be an example of a "second detection value" according to aspects of the present disclosure. The resistors R1 and R2 may be included in examples of a "first resistor" according to aspects of the present disclosure. The resistors R11 and R12 may be included in examples of a "second resistor" according to aspects of the present disclosure. The first main operational amplifier 161 may be an example of a "first output amplifier" according to aspects of the present disclosure, and may be an example of a "first differential amplifier" according to aspects of the present disclosure. The second main operational amplifier 171 may be an example of a "second output amplifier" according to aspects of the present disclosure, and may be an example of a "second differential amplifier" according to aspects of the present disclosure.

What is claimed is:

1. An image forming apparatus comprising:

a heating member configured to heat a sheet on which a toner image is formed;

a temperature sensor comprising:

a film configured to absorb infrared rays from the heating member;

a detection thermistor configured to output a first detection value corresponding to a temperature of the film; and a compensation thermistor configured to output a second detection value corresponding to a temperature of a holder holding the film;

a first amplifier configured to amplify a difference value between the first detection value and the second detection value with a first amplification factor;

a second amplifier configured to amplify the difference value between the first detection value and the second detection value with a second amplification factor higher than the first amplification factor;

a converter configured to:

generate first temperature information by performing analog-to-digital conversion of the difference value amplified with the first amplification factor;

generate second temperature information by performing analog-to-digital conversion of the difference value amplified with the second amplification factor; and generate compensation temperature information by performing analog-to-digital conversion of the second detection value; and a temperature determiner configured to:

determine a temperature of the heating member based on the second temperature information and the compensation temperature information, in a particular temperature range; and determine the temperature of the heating member based on the first temperature information and the compensation temperature information, outside the particular temperature range.

2. The image forming apparatus according to claim 1, wherein the first amplifier comprises:

a first operational amplifier configured to amplify a value corresponding to the difference value; and a first resistor that sets an amplification factor of the first operational amplifier to the first amplification factor, and wherein the second amplifier comprises:

a second operational amplifier configured to amplify a value corresponding to the difference value; and a second resistor that sets an amplification factor of the second operational amplifier to the second amplification factor.

3. The image forming apparatus according to claim 1, wherein the first amplifier comprises a first output amplifier having a first gain and configured to output a first output voltage to the converter, and wherein the second amplifier comprises a second output amplifier having a second gain and configured to output a second output voltage to the converter, the second gain being larger than the first gain.

4. The image forming apparatus according to claim 1, further comprising a temperature controller configured to control the temperature of the heating member using a temperature determined based on the second temperature information and the compensation temperature information, when a temperature indicated by the first temperature information or the second temperature information is included in the particular temperature range.

5. The image forming apparatus according to claim 4, wherein the temperature controller is further configured to control the temperature of the heating member using the temperature determined based on the second temperature information and the compensation temperature information, when a temperature indicated by the compensation temperature information is included in a conditional temperature range, and the temperature indicated by the first temperature information or the second temperature information is included in the particular temperature range.

6. The image forming apparatus according to claim 5, wherein the conditional temperature range is a temperature range within which the temperature of the holder of the temperature sensor is assumed to be when the sheet with the toner image formed is heated by the heating member.

7. The image forming apparatus according to claim 4, wherein the temperature controller is further configured to control the temperature of the heating member using a temperature determined based on the first temperature information and the compensation temperature information, when the temperature indicated by the compensation temperature information is not included in the conditional temperature range, or the temperature indicated by the first temperature information or the second temperature information is not included in the particular temperature range.

8. The image forming apparatus according to claim 1, wherein the particular temperature range is a temperature range within which the temperature of the heating member is likely to be when the sheet with the toner image formed is heated by the heating member.

9. An image forming apparatus comprising:

a heating member configured to heat a sheet on which a toner image is formed;

a temperature sensor comprising:

a detection thermistor configured to output a first detection value corresponding to a surface temperature of the heating member; and a compensation thermistor configured to output a second detection value corresponding to an environmental temperature of the temperature sensor;

a first differential amplifier having a first gain and configured to receive an input value corresponding to the first detection value and an input value corresponding to the second detection value; and a second differential amplifier having a second gain and configured to receive an input value corresponding to the first detection value and an input value corresponding to the second detection value, the second gain being larger than the first gain;

a converter configured to:

generate first temperature information by performing analog-to-digital conversion of an output value from the first differential amplifier;

generate second temperature information by performing analog-to-digital conversion of an output value from the second differential amplifier; and generate compensation temperature information by performing analog-to-digital conversion of the second detection value; and a temperature determiner configured to:

determine a temperature of the heating member based on the second temperature information and the compensation temperature information, in a particular temperature range; and determine the temperature of the heating member based on the first temperature information and the compensation temperature information, outside the particular temperature range.

10. The image forming apparatus according to claim 9, further comprising a temperature controller configured to control the temperature of the heating member using a temperature determined based on the second temperature information and the compensation temperature information, when a temperature indicated by the first temperature information or the second temperature information is included in the particular temperature range.

11. The image forming apparatus according to claim 10, wherein the temperature controller is further configured to control the temperature of the heating member using the temperature determined based on the second temperature information and the compensation temperature information, when a temperature indicated by the compensation temperature information is included in a conditional temperature range, and the temperature indicated by the first temperature information or the second temperature information is included in the particular temperature range.

12. The image forming apparatus according to claim 11, wherein the conditional temperature range is a temperature range within which a temperature of a holder of the temperature sensor is assumed to be when the sheet with the toner image formed is heated by the heating member.

13. The image forming apparatus according to claim 10, wherein the temperature controller is further configured to control the temperature of the heating member using a temperature determined based on the first temperature information and the compensation temperature information, when the temperature indicated by the compensation temperature information is not included in the conditional temperature range, or the temperature indicated by the first temperature information or the second temperature information is not included in the particular temperature range.

14. The image forming apparatus according to claim 9, wherein the particular temperature range is a temperature range within which the temperature of the heating member is likely to be when the sheet with the toner image formed is heated by the heating member.

* * * * *